US010062359B2

(12) United States Patent
Tsai et al.

(10) Patent No.: US 10,062,359 B2
(45) Date of Patent: Aug. 28, 2018

(54) IMAGE COMPENSATION METHOD APPLIED TO DISPLAY AND ASSOCIATED CONTROL CIRCUIT

(71) Applicant: MStar Semiconductor, Inc., Hsinchu Hsien (TW)

(72) Inventors: Shihheng Tsai, Hsinchu County (TW); Chung-Yi Chen, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 0 days.

(21) Appl. No.: 15/486,462

(22) Filed: Apr. 13, 2017

(65) Prior Publication Data

US 2018/0137838 A1 May 17, 2018

(30) Foreign Application Priority Data

Nov. 15, 2016 (TW) ..... 105137170 A

(51) Int. Cl.
*G09G 5/02* (2006.01)
*G09G 5/10* (2006.01)

(52) U.S. Cl.
CPC ..... *G09G 5/10* (2013.01); *G09G 2320/0271* (2013.01); *G09G 2320/0646* (2013.01); *G09G 2320/08* (2013.01)

(58) Field of Classification Search
CPC ..... G09G 5/02; G06T 11/001
USPC ..... 345/589
See application file for complete search history.

(56) References Cited

U.S. PATENT DOCUMENTS

2006/0268180 A1* 11/2006 Chou ..... G06T 5/009 348/673
2007/0092139 A1* 4/2007 Daly ..... G09G 3/3406 382/169
2008/0238856 A1* 10/2008 Bhowmik ..... G09G 3/3406 345/102
2008/0278762 A1* 11/2008 Seo ..... G03G 15/0115 358/3.06
2010/0002952 A1* 1/2010 Oizumi ..... G06T 5/004 382/266

(Continued)

OTHER PUBLICATIONS

Subr, K., Soler, C., and Durand, F. 2009. Edge-preserving multiscale image decomposition based on local extrema. ACM Transactions on Graphics (Proc. SIGGRAPH Asia) 28, 5.*

*Primary Examiner* — Jin Ge
(74) *Attorney, Agent, or Firm* — WPAT, PC

(57) ABSTRACT

A control circuit applied to a display includes an adjustment parameter generating circuit, an adjustment circuit, a compensation circuit, an image detail compensating circuit and an output circuit. The adjustment parameter generating circuit determines an adjustment parameter according to a backlight intensity corresponding to a pixel in a frame. The adjustment circuit adjusts a pixel value of the pixel according to the adjustment parameter to generate an adjusted pixel value. The compensation circuit compensates the adjusted pixel value according to a compensation curve go generate a compensated pixel value. The compensation curve includes a non-linear segment. The image detail compensating circuit generates a detail compensation value according to an edge factor of the pixel. The output circuit adjusts the compensated pixel value according to the detail compensation value to generate an output pixel value of the pixel.

3 Claims, 8 Drawing Sheets

(56) References Cited

U.S. PATENT DOCUMENTS

| | | | | |
|---|---|---|---|---|
| 2010/0329581 | A1* | 12/2010 | Yamazaki | G06T 5/004 382/254 |
| 2011/0037901 | A1* | 2/2011 | Ueyama | H04N 5/208 348/647 |
| 2011/0074803 | A1* | 3/2011 | Kerofsky | G09G 3/3406 345/589 |
| 2014/0340515 | A1* | 11/2014 | Tanaka | G06T 5/003 348/143 |
| 2015/0310791 | A1* | 10/2015 | Croxford | G09G 5/10 345/589 |

* cited by examiner

IMAGE COMPENSATION METHOD APPLIED TO DISPLAY AND ASSOCIATED CONTROL CIRCUIT

This application claims the benefit of Taiwan application Serial No. 105137170, filed Nov. 15, 2016, the subject matter of which is incorporated herein by reference.

BACKGROUND OF THE INVENTION

Field of the Invention

The invention relates to an image compensation method applied to a display and an associated control circuit.

Description of the Related Art

To increase visual contrast and to achieve power saving, for a region having a lower luminance in an image, some displays reduce the corresponding backlight intensity and compensate display data (i.e., a pixel value and/or a grayscale value) to allow a user to perceive the same luminance. However, in some situations, when the backlight intensity is reduced, the compensation performed on the display data may exceed a maximum value allowed, such that the display data is clamped to the maximum luminance to cause loss in details of the image. For example, assuming that pixels having pixel values and/or grayscales 128 to 255 in the original display data are compensated to the pixel value and/or grayscale 255, not only details in the image become distorted but also the contrast of the image is reduced.

SUMMARY OF THE INVENTION

The invention is directed to an image compensation method applied to a display and an associated control circuit, which employ a compensation curve to alleviate the phenomenon of a pixel value being clamped at a maximum luminance to solve the issues of image detail distortion and reduced contrast in the prior art.

According to an embodiment of the present invention, a control circuit applied to a display includes an adjustment parameter generating circuit, an adjustment circuit, a compensation circuit, an image detail compensating circuit and an output circuit. The adjustment parameter generating circuit determines and adjustment parameter according to a backlight intensity corresponding to a pixel in a frame. The adjustment circuit adjusts a pixel value of the pixel according to the adjustment parameter to generate an adjusted pixel value. The compensation circuit compensates the adjusted pixel value according to a compensation curve to generate a compensated pixel value. The compensation curve includes a non-linear segment. The image detail compensating circuit generates a detail compensation value according to an edge factor of the pixel. The output circuit adjusts the compensated pixel according to the detail compensation value to generate an output pixel value of the pixel.

According to another embodiment of the present invention, a control circuit applied to a display includes an adjustment parameter generating circuit, an adjustment circuit and a compensation circuit. The adjustment parameter generating circuit determines an adjustment parameter according to a backlight intensity corresponding a pixel in a frame. The adjustment circuit adjusts a pixel value of the pixel according to the adjustment parameter to generate an adjusted pixel value. The compensation circuit compensates the adjusted pixel value according to a compensation curve to generate a compensated pixel value. The compensation curve includes a straight-line part and a secondary-curve part.

According to another embodiment of the present invention, an image compensation method applied to a display is provided. The image compensation method includes: receiving a frame; determining an adjustment parameter according to a backlight intensity corresponding to a pixel in the frame; adjusting a pixel value of the pixel according to the adjustment parameter to generate an adjusted pixel value; compensating the adjusted pixel value according to a compensation curve to generate a compensated pixel value, wherein the compensation curve includes a non-linear segment; generating a detail compensation value according to an edge factor of the pixel; and adjusting the compensated pixel value according to the detail compensation value to generate an output pixel value of the pixel.

According to another embodiment of the present invention, an image compensation method applied to a display is provided. The image compensation method includes: receiving a frame; determining an adjustment parameter according to a backlight intensity corresponding to a pixel in the frame; adjusting a pixel value of the pixel according to the adjustment parameter to generate an adjusted pixel value; and compensating the adjusted pixel value according to a compensation curve to generate a compensated pixel value, wherein the compensation curve includes a straight-line part and a secondary-curve part.

The above and other aspects of the invention will become better understood with regard to the following detailed description of the preferred but non-limiting embodiments. The following description is made with reference to the accompanying drawings.

DETAILED DESCRIPTION OF THE INVENTION

Figure 1:
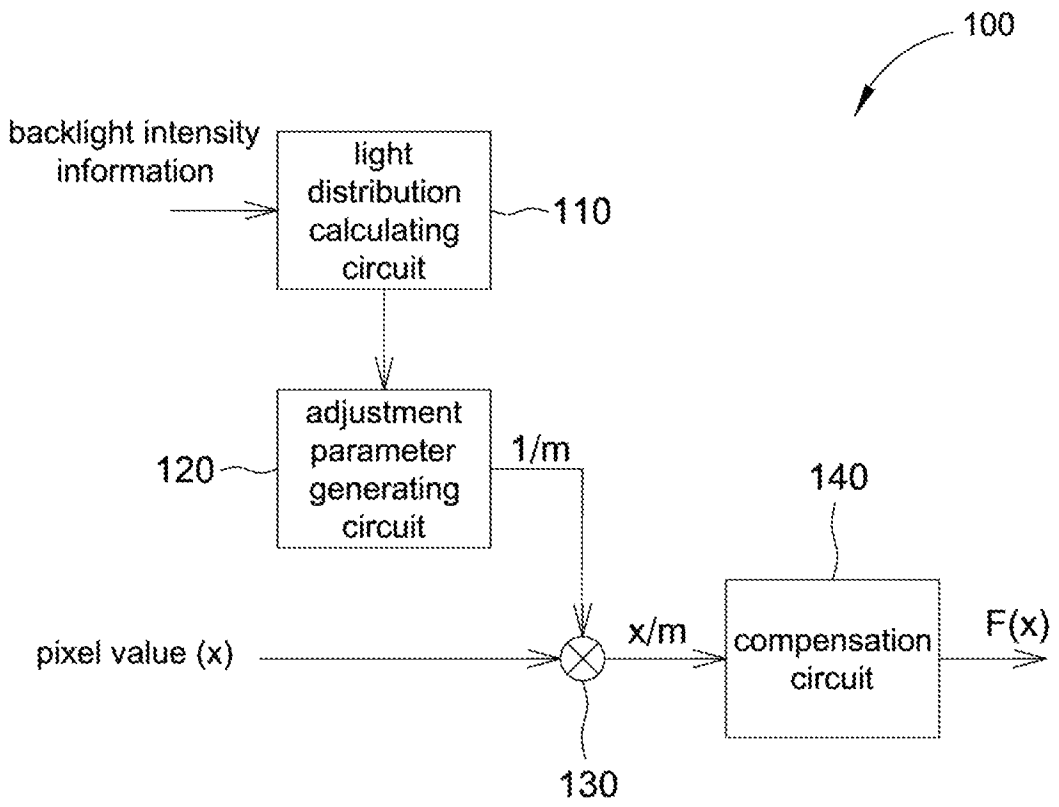
FIG. 1 is a block diagram of a control circuit according to an embodiment of the present invention.

FIG. 1 shows a block diagram of a control circuit 100 according to an embodiment of the present invention. The control circuit 100 is disposed in a display, and generates display data according to frame data of an image to a panel of the display to accordingly control pixel display. As shown in FIG. 1, the control circuit 100 includes a light distribution calculating circuit 110, an adjustment parameter generating circuit 120, an adjustment circuit 130 and a compensation circuit 140. These components may be implemented by one or multiple chips by means of software cooperating with hardware.

The control circuit 100 reduces the light intensity of a backlight module (not shown) according to current image information (e.g., luminance statistical information) to save the power consumption of the backlight module, and obtains a luminance value (i.e., backlight intensity information) of each light emitting element in the backlight module. The light distribution calculating circuit 110 calculates a total backlight intensity that each block of the image frame receives from the backlight module according to the backlight luminance information. In addition to light beams from light emitting elements located right behind, each block of the image frame also receives light beams generated by light emitting elements corresponding to nearby blocks. Thus, the light distribution calculating circuit 110 determines the total backlight intensity received by the blocks according to the backlight intensity information and respective light distribution functions of the light emitting elements. For a pixel in an image frame that the control circuit 100 receives, the adjustment parameter generating circuit 120 determines an adjustment parameter according to the backlight intensity corresponding to the pixel. In this embodiment, assuming that the backlight intensity corresponding to the pixel is m times of a normal backlight intensity, where m is a value between 0 and 1, the adjustment parameter is (1/m). It should be noted that the above example is not a limitation to the present invention. According to the adjustment parameter, the adjustment circuit 130 adjusts a pixel value of the pixel to generate an adjusted pixel value. In this embodiment, the adjusting circuit 130 is a multiplier; that is, assuming the pixel value is x, the adjusted pixel value is then (x/m). The compensation circuit 140 compensates the adjusted pixel value (x/m) according to a compensation curve to generate a compensated pixel value F(x), and transmits the compensated pixel value to a display panel for display, thereby preventing the compensated pixel value (x/m) from exceeding the maximum luminance value.

Figure 2:
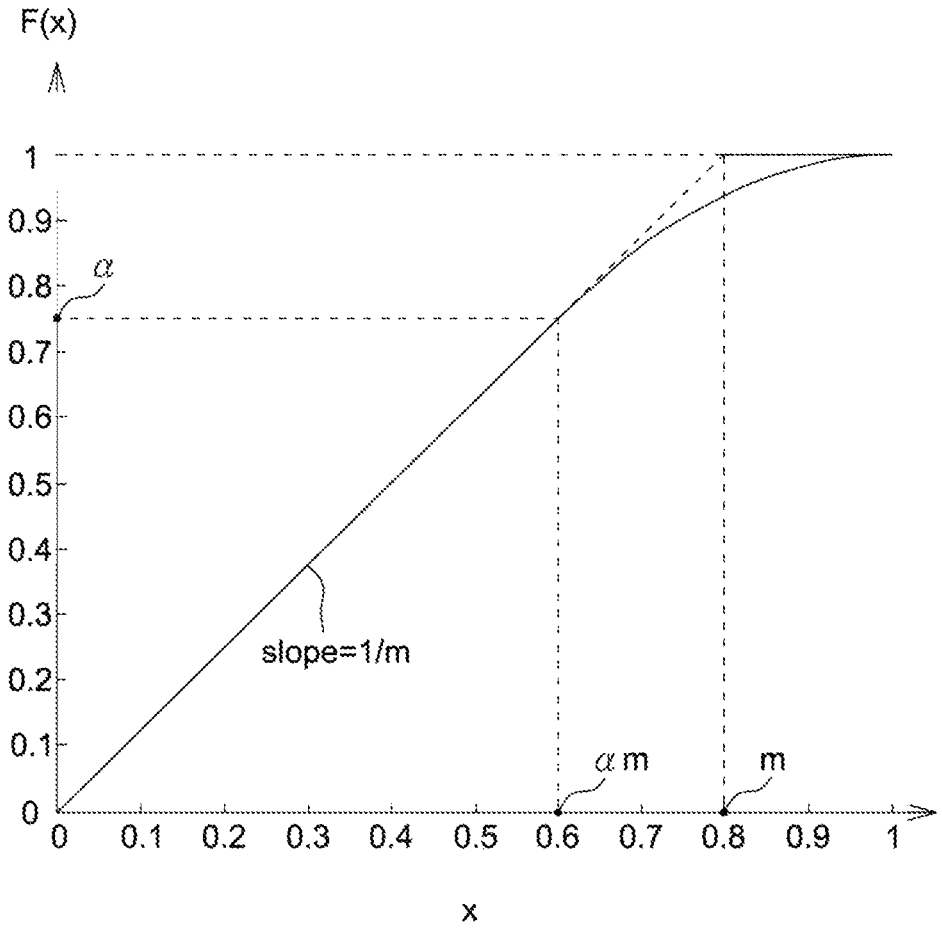
FIG. 2 is a schematic diagram of a compensation curve according to an embodiment of the present invention.

FIG. 2 shows a schematic diagram of a compensation curve F(x) according to an embodiment of the present invention. For illustration purposes, the compensation curve in FIG. 2 is a normalized curve. The compensation curve F(x) is divided into two parts. When a normalized pixel value x is between 0 and ($\alpha$*m), a slope of the compensation curve F(x) is equal to a straight line having a slope (1/m), i.e., the straight-line part of the compensation curve. When the normalized pixel value x is between ($\alpha$*m) and 1, the compensation curve F(x) is a secondary curve, i.e., the secondary-curve part of the compensation curve. The value a may be determined by a designer according to characteristics of the display panel. Through the compensation method in FIG. 2, the compensated pixel value is prevented from exceeding the maximum luminance value (e.g., from being greater than 255).

Figure 3:
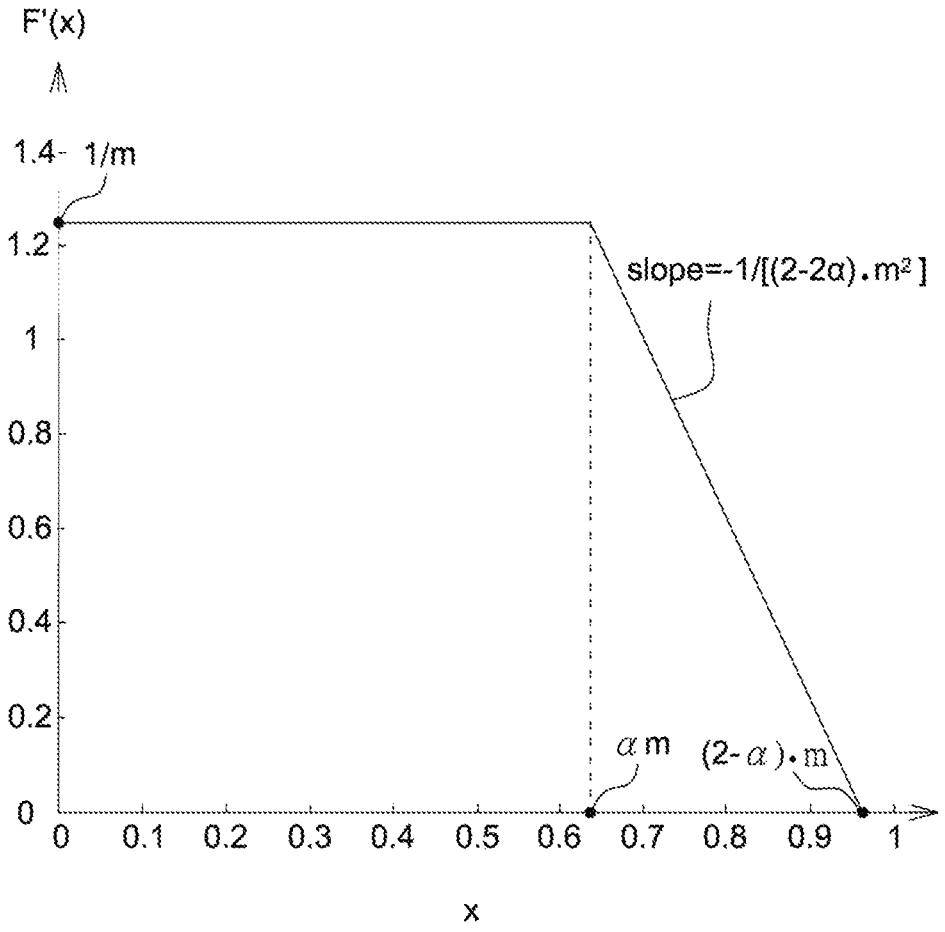
FIG. 3 is a schematic diagram of a linear differentiation of a compensation curve.

FIG. 3 shows a schematic diagram of linear differentiation F'(x) of the compensation curve F(x). Similar to FIG. 2, the compensation curve having been linearly differentiated in FIG. 3 is a normalized curve. To maintain the maximum luminance of the entire frame, the area below the curve F'(x) may be designed as 1 to further deduce that, F'(x)=0 when the normalized pixel value x=(2−$\alpha$)*m, and the slope is −1/[(2−2$\alpha$)*$m^2$] when the normalized pixel value x>($\alpha$*m).

The embodiment in FIG. 1 is capable of preventing the compensated pixel value from exceeding the maximum luminance. However, in a region where the adjusted pixel value x already exceeds the maximum luminance value (i.e., the normalized pixel value x>m), differences between the compensated pixel values F(x) corresponding to different adjusted pixel values x are significantly reduced, in a way that edges of the image at high-luminance areas may appear much less distinct. Therefore, in another embodiment of the present invention, an image detail compensating circuit is provided to further compensate details at an edge of an image.

Figure 4:
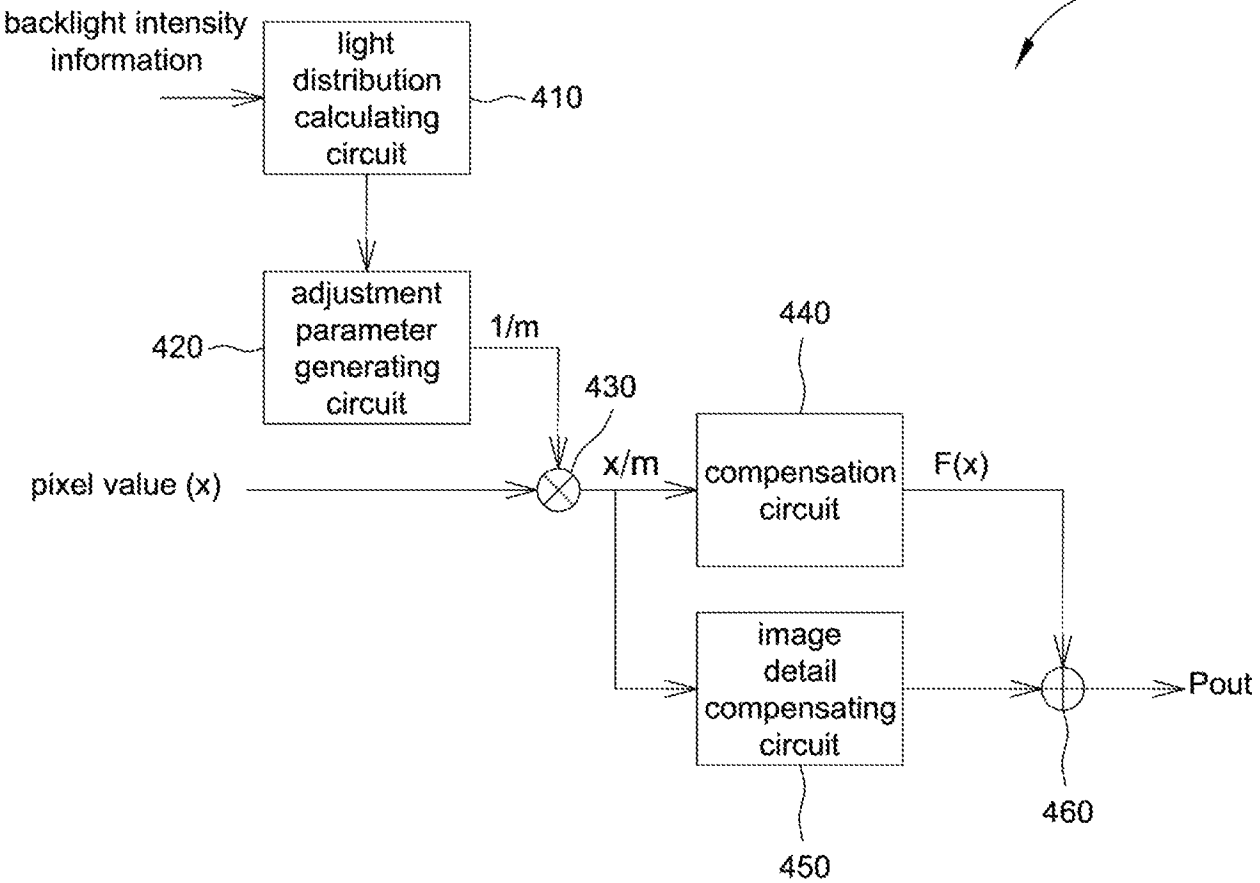
FIG. 4 is a block diagram of a control circuit according to another embodiment of the present invention.

FIG. 4 shows a control circuit 400 according to another embodiment of the present invention. The control circuit 400 is disposed in a display, and generates display data to a panel of the display to accordingly control pixel display. As shown in FIG. 4, the control circuit 400 includes a light distribution calculating circuit 410, an adjustment parameter generating circuit 420, an adjustment circuit 430, a compensation circuit 440, an image detail compensating circuit 450 and an output circuit 460. These components may be implemented by one or multiple chips by means of software cooperating with hardware.

Operations of the light distribution calculating circuit 410, the adjustment parameter generating circuit 420, the adjustment circuit 430, the compensation circuit 440 in the control circuit 400 are identical to those of the light distribution calculating circuit 110, the adjustment parameter generating circuit 120, the adjustment circuit 130 and the compensation circuit 140 in FIG. 1, and shall be omitted herein. Regarding the image detail compensating circuit 450 and the output circuit 460, the image detail compensating circuit 450 obtains an edge factor of a pixel according to an adjusted pixel value (x/m) of the pixel to accordingly generate a detail compensation value. The output circuit 460 then further compensates the compensated pixel value F(x) according to the detail compensation value to generate an output pixel value Pout of the pixel to a backend display panel for display.

Figure 5:
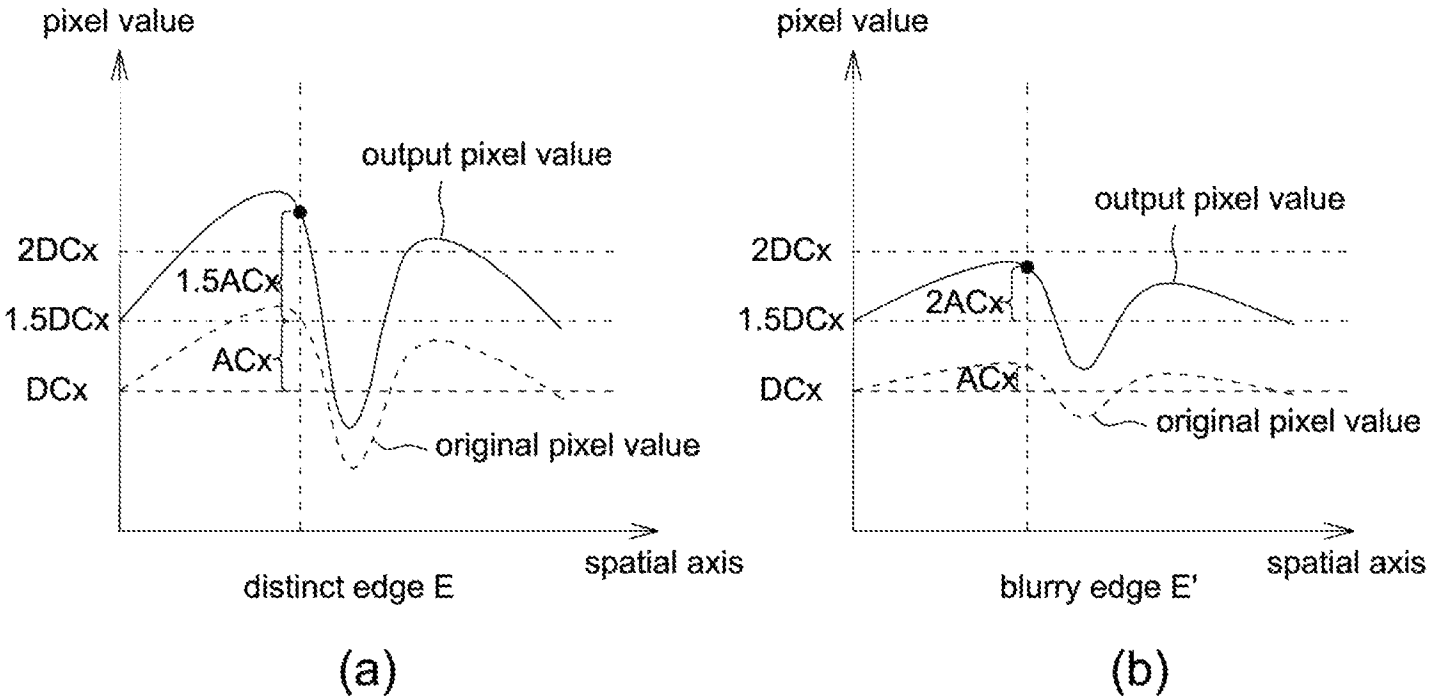
FIG. 5 is a schematic diagram of an image detail compensating circuit generating a detail compensation value for adjusting a compensated pixel value to generate an output pixel value of a pixel.

FIG. 5(*a*) shows a schematic diagram of the image detail compensating circuit 450 generating the detail compensation value for adjusting the compensated pixel value F(x) to generate the output pixel value Pout of the pixel. In FIG. 5(*a*), it is assumed that the pixel value x of the pixel may be separated into an original average DCx and an original variance ACx, i.e., the pixel value x=DCx+ACx. The original average DCx refers to an average value of pixel values of the pixel, preceding pixels and subsequent pixels, e.g., an average luminance value of the pixel, three preceding pixels and three subsequent pixels. The larger the original average is, the higher the average luminance of the pixel and the surrounding pixels is. The original variance ACx refers to a difference between the pixel and the corresponding original average, e.g., a difference between the luminance value of the pixel and the luminance value of the corresponding original average DCx. The larger the original variance is, the greater the difference between the pixel and the surrounding pixels is, i.e., the larger the edge factor is. When the pixel is located at a distinct edge (i.e., having a larger edge factor) E, even after the compensation performed by the compensation circuit, the pixel may still differ sufficiently from the surrounding pixels. At this point, the detail compensation value generated by the image detail compensating circuit 450 may be 0 or a very low value, in a way that the compensated pixel value F(x) may directly serve as the output pixel value Pout of the pixel. Alternatively, the original average DCx and the original variance ACx may be respectively adjusted according to the same gain (e.g., 1.5 times). On the other hand, referring to FIG. 5(*b*), when the pixel is located at a blurry edge (i.e., having a lower edge factor) E', once compensated by the compensation circuit, the pixel may become too similar to the surrounding pixels to lose details. At this point, the detail compensation value generated by the image detail compensation circuit 450 may be a larger value, such that the original average DCx and the original variance ACx may perform the adjusted respectively according to different gains (e.g., the original average DCx is adjusted by 1.5 times, and the original variance ACx is adjusted by 2 times). Thus, image details are not lost when the compensation curve F(x) in FIG. 2 is adopted. It should be noted that, the dotted lines of DCx, 1.5DCx and 2DCx in FIG. 5(*a*) and FIG. 5(*b*) are for indicating the average DCx corresponding to pixels located at the distinct edge E and the blurry edge E', and the average value DCx calculated for individual pixels at different positions may not be equal.

In practice, when the pixel has different edge factors e, the image detail compensating circuit 450 may generate different detail compensation values according to different edge factors e. In one embodiment of the present invention, the detail compensation value generated by the image detail compensating circuit 450 is $(1-e)(1-mF'(DC_x))*(AC_x/m)$, where e is between 0 and 1. The difference in pixel values of the pixel and the surrounding pixels gets larger as the value e gets larger, and the detail compensation value approximates 0 when the edge e approximates 1.

Figure 6:
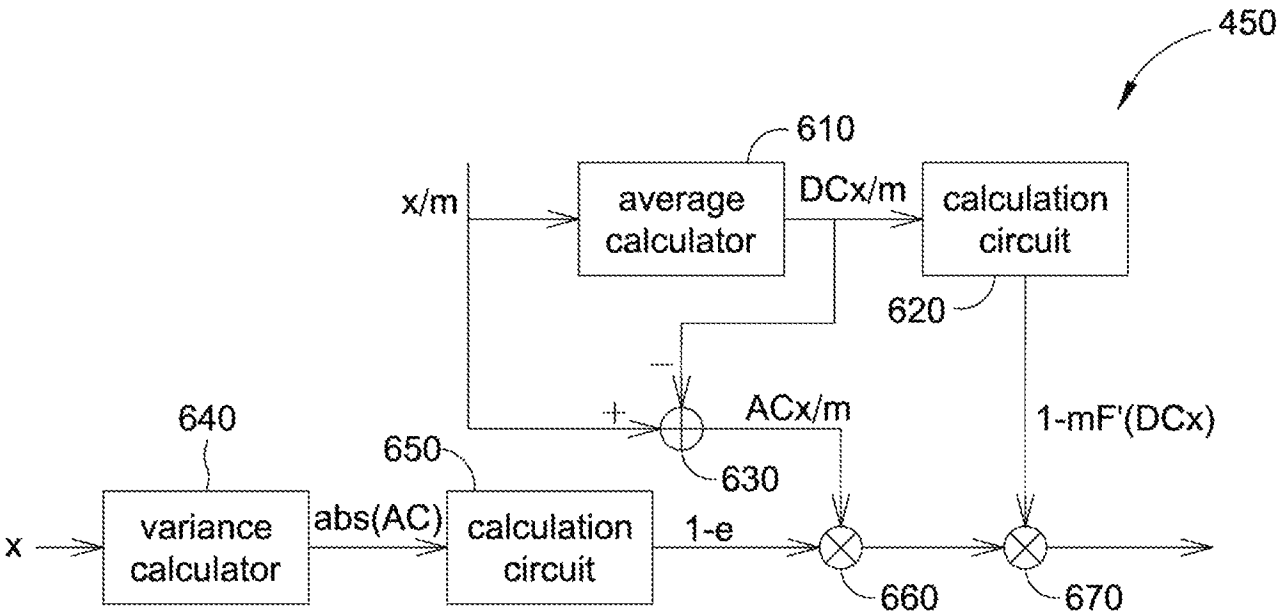
FIG. 6 is a block diagram of an image detail compensating circuit according to an embodiment of the present invention.

FIG. 6 shows a block diagram of the image detail compensating circuit 450 according to an embodiment of the present invention. The image detail compensating circuit 450 includes an average calculator 610, a calculating circuit 620, a subtractor 630, a variance calculator 640, a calculation circuit 650 and two multipliers 660 and 670. In an operation process of the image detail compensating circuit 450, the average calculator 610 first calculates the adjusted pixel value (x/m) to obtain an average (DCx/m) of the adjusted pixel. In this embodiment, the average calculator 610 may be a 7-order, 5-order or 3-order spatial filter, and perform a weighted average calculation on a target pixel and surrounding pixels of the target pixel to obtain the average (DCx/m) of the adjusted pixel. The calculating circuit 620 applies the compensation curve F(x) or the linear differentiation curve F'(x) in FIG. 2 and FIG. 3 to calculate (1−m*F'(DCx)). Meanwhile, the subtractor 630 subtracts the adjusted pixel value (x/m) and the average (DCx/m) of the adjusted pixel from each other to obtain the variance (ACx/m) of the adjusted pixel. Further, the variance calculator 640 calculates the absolute value (abs(AC)) of the variance (ACx/m) according to the pixel value (x), and the calculation circuit 650 calculates information (1−e) associated with the edge factor according to abs(AC). The multipliers 660 and 670 then multiply (1−e), (ACx/m) and (1−m*F'(DCx)) to obtain the detail compensation value $(1-e)(1-mF'(DC_x))*(AC_x/m)$. In practice, the average calculator 610 may be replaced by a low-pass filter, and the variance calculator 640 may be replaced by a high-pass filter. Although the low-pass/high-pass filters have higher production costs, given appropriately set thresholds, the low-frequency components extracted from the signal by the low-pass filter may replace the average (DCx/m) of the adjusted pixel, and the high-frequency components extracted from the signal by the high-pass filter may replace the variance (ACx) of the pixel.

The output circuit 460 adds the adjusted pixel value F(x) and the detail compensation value $(1-e)(1-mF'(DC_x))*(AC_x/m)$ to obtain the output pixel value Pout, which is equal to $F(x)+(1-e)(1-mF'(DC_x))*(AC_x/m)$.

It should be noted that, the pixel value x of the pixel in the application may be the luminance value of the pixel, or the luminance value of one of the three sub-pixels (i.e., red, green and blue sub-pixels) of the pixel. The pixel values x received by the adjusting circuit 430 and the variance calculator 640 may both be the luminance value of the pixel, both be the luminance value of one of the three sub-pixels (i.e., red, green and blue sub-pixels) of the pixel, or one of them be the luminance value of the pixel and one another be one of the three sub-pixels. Further, when the pixel value x received by the adjustment circuit 430 is the luminance value of the pixel, the control circuit 100/400 needs to further calculate the output luminance values of the three individual sub-pixels according to the output pixel value Pout for the display panel to display.

In the foregoing embodiment, the value a in the compensation curve F(x) is a constant value predetermined by a designer, and the value m changes as the backlight intensity differs. Therefore, in some circumstances, the compensation curve F(x) may not achieve complete compensation. For example, referring to FIG. 7, when a predetermined relationship exists between the values α and m, F(1) may not equal to 1, such that the compensated pixel value may be lower than the pixel value 255 when the pixel value x is 255 and the backlight intensity is reduced. To solve this issue, the compensation circuit 140 in FIG. 1 and the compensation circuit 440 in FIG. 4 may include at least two sets of secondary-curve equations respectively corresponding to a first curve and a second curve. The compensation circuit 140/440 may determine which set of secondary-curve equations is to be used to calculate the compensated pixel value to ensure that F(1) is equal to 1 under all circumstances.

Figure 7:
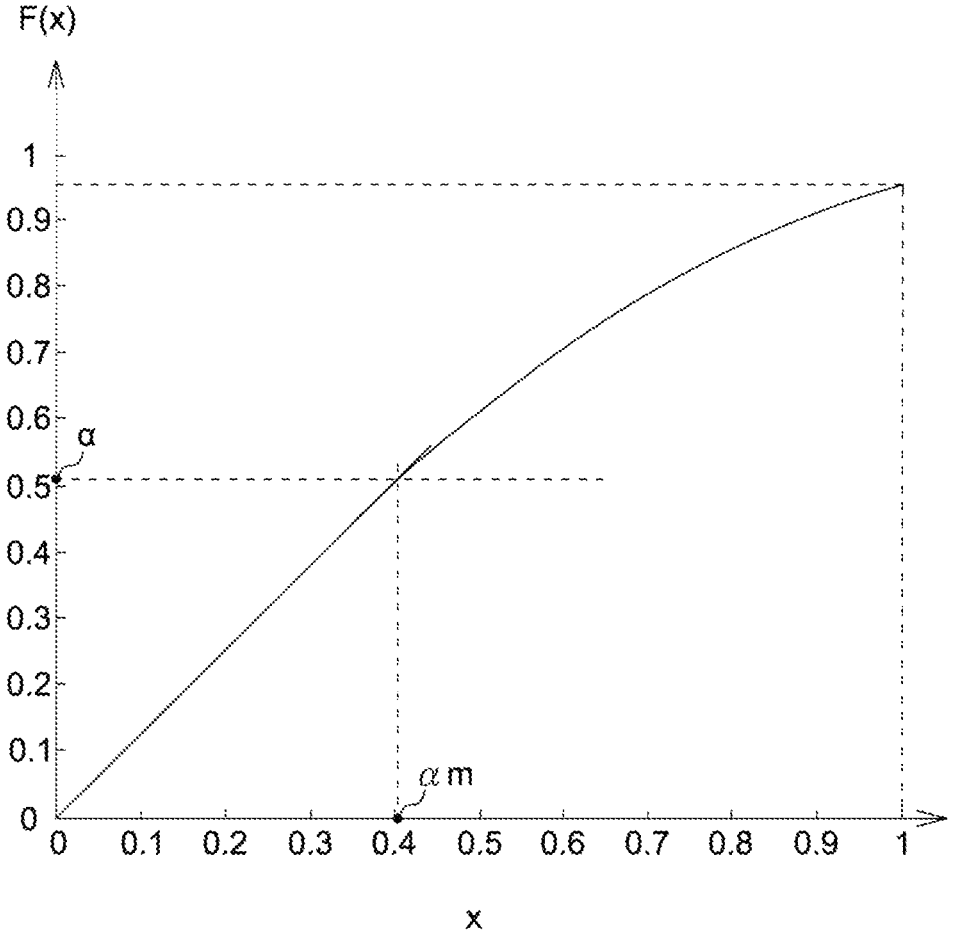
FIG. 7 is a schematic diagram of a compensation curve that is incapable of completely compensating a pixel value.

In this embodiment, according to FIG. 2 and FIG. 3, it is deduced that, F(1) may not equal to 1 when (1/m) is smaller than (2−α), as shown in FIG. 7. Thus, the compensation circuit 140/440 may determine whether (1/m) is greater than or smaller than (2−α) to determine which set of secondary-curve equation is to be used in order to have F(1) equal to 1. For example, when the normalized pixel value is (α*m) to 1, and (1−m) is greater than (2−α), the compensation circuit 110/440 uses the first curve $$F(x) = 1 - \frac{1}{4(1-\alpha)}\left(2-\alpha-\frac{x}{m}\right)^2$$

as the equation for the secondary-curve part; when the normalized pixel value is (α*m) to 1, and (1−m) is smaller than (2−α), the compensation circuit 110/440 uses the second curve $$F(x) = \frac{x}{m} - \left(\frac{1}{m}-1\right)\left(\frac{x/m-\alpha}{1/m-\alpha}\right)^2$$

the equation for the secondary-curve part.

Figure 8:
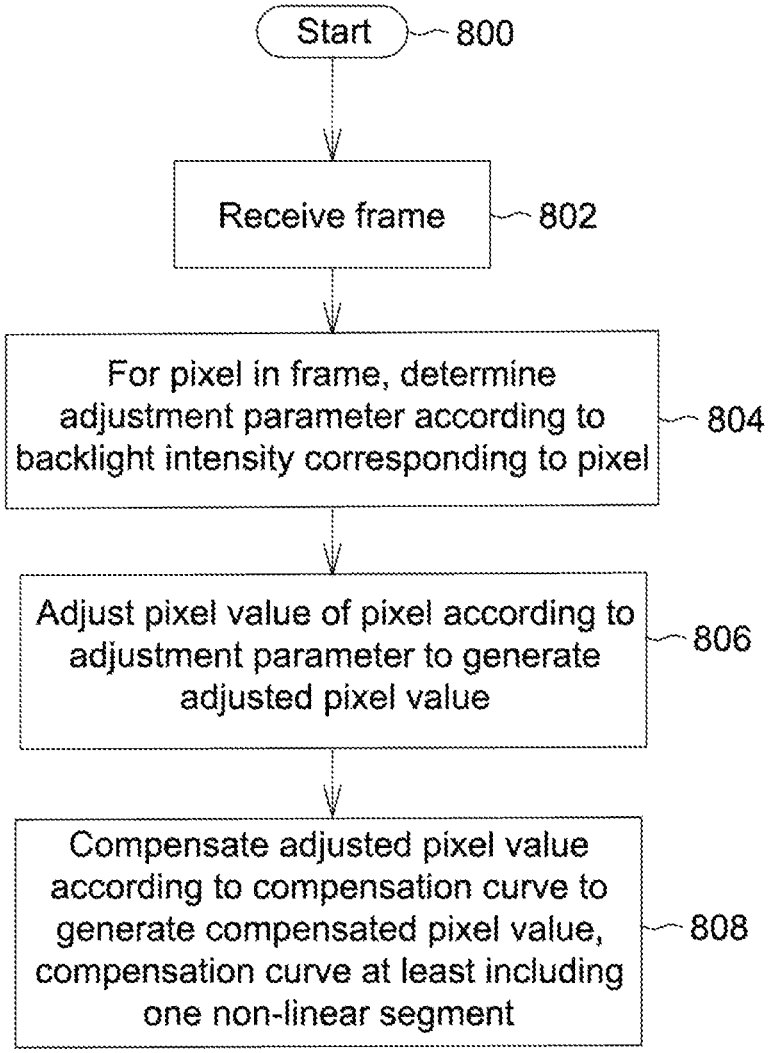
FIG. 8 is a flowchart of an image compensation method applied to a display according to an embodiment of the present invention.

FIG. 8 shows a flowchart of an image compensation method applied to a display according to an embodiment of the present invention. Referring to the description of the foregoing embodiments, the process in FIG. 8 includes following steps.

In step 800, the process begins.

In step 802, a frame is received.

In step 804, for a pixel in the frame, an adjustment parameter is determined according to a backlight intensity corresponding to the pixel.

In step 806, a pixel value of the pixel is adjusted according to the adjustment parameter to generate an adjusted pixel value.

In step 808, the adjusted pixel value is compensated according to a compensation curve to generate a compensated pixel value. The compensation curve at least includes a non-linear segment.

In conclusion, in the image compensation method applied to a display and the associated control circuit, a compensation curve including a secondary curve is used to adjust a pixel value to prevent an adjusted pixel value from exceeding the maximum luminance value. Further, an image detail compensating circuit is further provided according to an embodiment of the present invention. The image detail compensating circuit is capable of solving the issue of losing a part of details in a high-luminance region caused by adopting the compensation curve of the present invention for compensating an image.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control circuit, applied to a display, comprising:

an adjustment parameter generating circuit, determining an adjustment parameter according to a backlight intensity corresponding to a pixel in a frame; wherein:

when the adjustment parameter is greater than a predetermined value, the compensation circuit compensates the adjusted pixel value according to a first curve corresponding to the secondary-curve part of the compensation curve; and when the adjustment parameter is smaller than the predetermined value, the compensation circuit compensates the adjusted pixel value according to a second curve corresponding to the secondary-curve part of the compensation curve;

an adjustment circuit, adjusting a pixel value of the pixel according to the adjustment parameter to generate an adjusted pixel value; and a compensation circuit, compensating the adjusted pixel value according to a compensation curve to generate a compensated pixel value for transmission of the compensated pixel value to the display to display the pixel;

wherein, the compensation curve comprises a straight-line part and a secondary-curve part.

2. The control circuit according to claim 1, wherein when the pixel value is between 0 to ($\alpha$*m), the compensation circuit compensates the adjusted pixel value according to the straight-line part of the compensation curve; when the pixel value is between ($\alpha$*m) to 1 and (1/m) is greater than (2–$\alpha$), the compensation circuit compensates the adjusted pixel value according to a first curve corresponding to the secondary-curve part of the compensation curve; and when the pixel value is between ($\alpha$*m) to 1 and (1/m) is smaller than (2–$\alpha$), the compensation circuit compensates the adjusted pixel value according to a second curve corresponding to the secondary-curve part of the compensation curve, m is the adjustment parameter, $\alpha$ is a predetermined value, and $\alpha$ and m are real numbers.

3. The control circuit according to claim 1, wherein the compensation circuit uses $$F(x) = 1 - \frac{1}{4(1-\alpha)}\left(2 - \alpha - \frac{x}{m}\right)^2$$

as an equation of the first curve, and uses $$F(x) = \frac{x}{m} - \left(\frac{1}{m} - 1\right)\left(\frac{x/m - \alpha}{1/m - \alpha}\right)^2$$

as an equation of the second curve, where x is the pixel value of the pixel, and $\alpha$ and m are real numbers.

* * * * *